US007513197B2

(12) United States Patent
Kückelmann et al.

(10) Patent No.: US 7,513,197 B2
(45) Date of Patent: Apr. 7, 2009

(54) METHOD OF EXCHANGING A PRINTING UNIT AT A RUNNING ROTARY PRINTING PRESS

(75) Inventors: Andreas Kückelmann, Ibbenbüren (DE); Wolfgang Brusdeilins, Blelefeld (DE); Gordon Whitelaw, Bielefeld (DE)

(73) Assignee: Fischer & Krecke GmbH & Co. KG, Bielefeld (DE)

( * ) Notice: Subject to any disclaimer, the term of this patent is extended or adjusted under 35 U.S.C. 154(b) by 307 days.

(21) Appl. No.: 11/613,162

(22) Filed: Dec. 19, 2006

(65) Prior Publication Data

US 2007/0144391 A1 Jun. 28, 2007

(30) Foreign Application Priority Data

Dec. 27, 2005 (EP) ..... 05028488

(51) Int. Cl.
*B41F 13/14* (2006.01)
*B41F 13/12* (2006.01)

(52) U.S. Cl. ..... 101/486; 101/481; 101/485

(58) Field of Classification Search ..... 101/248, 101/481, 484, 485, 486, DIG. 36
See application file for complete search history.

(56) References Cited

U.S. PATENT DOCUMENTS 4,809,609 A * 3/1989 Sugiura et al. ..... 101/485
5,570,633 A 11/1996 Schultz et al.
2002/0134267 A1 9/2002 Kolbe et al.

FOREIGN PATENT DOCUMENTS

DE 19527199 A1 1/1997
DE 19832892 A1 1/2000
GB 2146291 A 4/1985

* cited by examiner

*Primary Examiner*—Scott B. Geyer
*Assistant Examiner*—Jennifer Simmons
(74) *Attorney, Agent, or Firm*—Richard M. Goldberg

(57) ABSTRACT

A method of exchanging printing units at a running rotary printing press, wherein a first printing unit is withdrawn from the printing medium, and a second printing unit for printing the same image with the same register is set against the printing medium, includes the steps of applying to the printing cylinder of the second printing unit, prior to start of the printing operation, a register printing block elevated relative to the regular printing block; prior to changeover of the printing units, setting the second printing unit against the printing medium such that register marks print with the register printing block without an image printing with the regular printing block; detecting register marks and adjusting the second printing unit register by reference to the detected register mark; and with the register adjusted, exchanging the printing units by withdrawing the first printing unit and setting the second printing unit.

6 Claims, 2 Drawing Sheets

METHOD OF EXCHANGING A PRINTING UNIT AT A RUNNING ROTARY PRINTING PRESS

BACKGROUND OF THE INVENTION

The invention relates to a method of exchanging a printing unit at a running rotary printing press, wherein at least one first printing unit is withdrawn from a printing medium and a second printing unit for printing the same image with the same register is set against the printing medium.

When certain kinds of printing media, such as fleece for baby diapers, are printed on a rotary printing press such as a flexographic printing press, the printing cylinders employed therein have only a short lifetime, because the printing plates are soiled relatively quickly by, e.g., dust particles that are released from the printing medium. For this reason, frequent interruptions of the operation for cleaning the printing plates on the printing cylinders are necessary. This causes a reduction of the productivity and, consequently, increased costs.

SUMMARY OF THE INVENTION

In view of this problem, the applicant has already shown, on the fair DRUPA 2004 from May 16, to May 19, 2004 in Düsseldorf, Germany, a flexographic printing press wherein, adjacent to a central impression cylinder, two sets of printing units are provided which can alternatingly be set against and withdrawn from the printing medium. When the printing plates on the printing cylinders of the first set have become soiled, a changeover to the second set is performed without having to interrupt the operation of the printing press. While the image to be printed is printed with the printing units of the second set, the printing cylinders of the first set can be withdrawn so far that they can be cleaned without any risk. When the printing cylinders of the second set have become soiled, the printing operation can thus be continued with the cleaned printing cylinders of the first set. In this way, expensive interruptions of the printing operation can be avoided.

However, in view of the further processing of the printing medium, it is required that the printed images that have been printed alternatingly with the printing units of the first and the second set are exactly in registry with one another. Closed-loop control systems have become known, which permit a largely automated feedback-control of the register, so that the colour separations of the printed image that are printed with different printing units can be superposed in registry. These control systems comprise a video camera which detects the position of register marks on the printing medium. Then, for the purpose of adjusting the longitudinal register, for example, the drive system for the printing cylinders is feedback-controlled on the basis of detected positions of the register marks until all printing units are exactly in registry.

In the printing press described above, the register must be re-adjusted after each exchange of the printing units. Since, however, this operation requires a certain amount of time, in case of a high-speed printing press running at a printing speed of, e.g., 600 to 1000 m/min, as much as 100 m or more of waste may be produced after each exchange of the printing units before the register has been adjusted again with sufficient accuracy. This implies not only a loss in productivity but has also the consequence that a part of the cost savings achieved by alternatingly printing with two sets of printing units is consumed by increased material costs.

It is an object of the invention to provide a method that permits a reduced consumption of material when a printing unit is exchanged while the printing press is running.

According to the invention, this object is achieved by a method comprising the following steps:

- before the printing operation starts, the printing cylinder of the second printing unit is provided with a register printing block that is elevated relative to the regular printing blocks,
- before the printing units are exchanged, the second printing unit is shifted towards the printing medium to such an extent that register marks are printed with the register printing block, without a printed image being printed with the regular printing blocks,
- the register marks are detected, and the register of the second printing unit is adjusted on the basis of the detected register marks,
- when the register has been adjusted, the exchange of the printing units is performed by withdrawing the first printing unit and fully setting the second printing unit.

Thus, in this method, the feedback-adjustment of the register is performed already before the actual changeover of the printing units, so that the printing operation with the new printing unit of the new set of printing units can be continued in registry immediately after the changeover, without substantial amounts of waste being produced.

Preferred embodiments of the method are indicated in the dependent claims.

The register printing block that is used for printing the register marks while the register is adjusted must be slightly elevated in comparison to the regular printing block of the printing cylinder in order to prevent the regular printing block, i.e. the effective surface of the printing cylinder, from coming into contact with the printing medium in this phase. Otherwise, the image printed with the first printing unit would be superposed by the image printed with the second printing unit. On the other hand, however, the register printing block must not compromise the printing of the regular printed image with the second printing unit after the changeover of the printing units. This can conveniently be achieved by forming the register printing block from a resilient material, so that it may be compressed when coming into engagement with the printing medium supported on the central impression cylinder, when the printing cylinder is fully set against the printing medium.

Preferably, the register printing block is made of an elastic material that can elastically restore its original configuration after it has been compressed by the central impression cylinder, and which may therefore be used again for printing register marks in subsequent instances of exchanging the printing units. Such a resilient or elastic register printing block facilitates also the inking of the printing cylinder with an anilox roller that has a uniform diameter over its entire length and rolls over both, the regular printing block and the register printing block in order to transfer ink onto the printing cylinder. As an alternative, it is possible, however, that the diameter of the anilox roller is reduced in a marginal portion of the web of the printing medium, where the register marks are formed, so that the slightly elevated register printing block will be inked but not compressed.

Optionally, the ink supply system may be configured such that the portion of the printing cylinder where the register printing block is formed is supplied with ink only during the adjustment operation prior to a changeover of the printing units.

Register marks that have been printed with the printing cylinder of the first printing unit may be used as reference for adjusting the register of the second printing unit. Optionally, these register marks may be formed by register printing blocks that serve for adjusting the register of the first printing unit in the next changeover (from the second printing unit back to the first one).

BRIEF DESCRIPTION OF THE DRAWINGS

An embodiment example will now be described in conjunction with the drawings, wherein.

DETAILED DESCRIPTION

Figure 1:
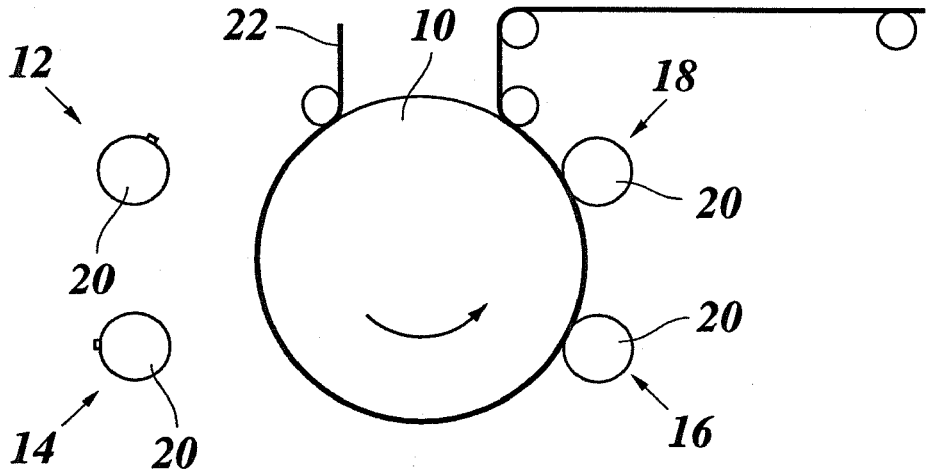
FIG. 1 is a schematic view of a flexographic printing press in a first operating condition.

FIG. 1 schematically shows a flexographic printing press having a central impression cylinder (CI) 10 and a number of printing units (12, 14, 16, 18) arranged at the periphery thereof. As is conventional for flexographic printing presses, each printing unit comprises a printing cylinder and an anilox roller, which has not been shown, and an inking system for inking the anilox roller.

In the example shown, the printing units 16 and 18 form a first set with which a two-colour image can be printed onto a web 22 of a print medium running over the CI 10. Accordingly, the printing cylinder 20 of each printing unit 16, 18 carries on its surface a printing block for a colour separation of the desired image, and the registers of the printing cylinders 20 are adjusted such that the colour separation images are superposed in registry with one another.

The printing units 12 and 14 form a second set of printing units that serve for printing the same image. Thus, the printing cylinder 20 of the printing unit 12 has the like printing block as the printing cylinder of the printing unit 16, and the printing block in the printing unit 14 corresponds to that in the printing unit 18. In FIG. 1, the printing units 12 and 14 of the second set are inactive, and their printing cylinders 20 are withdrawn from the peripheral surface of the CI 10.

The printing press shown herein is particularly suited for printing onto webs 22 that consist of a material that causes a relatively rapid soiling of the printing blocks on the printing cylinders. Accordingly, when only a single set of printing units were present, the printing operation would have to be interrupted in intervals of, e.g., 15-20 minutes in order to clean the printing blocks. These intervals are considerably shorter than the intervals in which the coil of the web of the printing medium must be exchanged, and they therefore cause a significant reduction of the productivity of the printing press. In contrast, the printing press shown in FIG. 1 permits, in principle, a non-interrupted operation wherein one and the same printed image is printed alternatingly with the printing units 16 and 18 of the first set and the printing units 12, 14 of the second set. For the printing units that are not active, i.e. the printing units 12 and 14 in FIG. 1, the printing blocks can be cleaned while the printing press is running.

In practice, the number of printing units of an individual set may be larger than 2 and may amount to 4 or 5, for example, depending on the number of colours to be employed. Since the tendency of the printing blocks to become soiled does not only depend on the material of the web 22 but also on the consistency of the ink employed and the structure of the respective image to be printed, it is also possible that the printing blocks in the different units have different lifetimes. For this reason, a mode of operation is conceivable wherein only individual pairs of printing units are operating alternatingly, while other colour separations of the image are respectively printed with only a single printing unit which may continuously remain active because the printing block thereof does not tend to become soiled so rapidly.

However, when printing alternatingly with different printing units, it must be assured that the registers of the printing cylinders that are alternatingly exchanged with one another are accurately aligned with one another, so that the printed image will always be printed in registry onto the web 22, irrespective of which of the printing units has been used for printing. Otherwise, a further processing of the printed web in a manner specifically adapted to the register of the printed image, e.g. punching, crimping and the like, would not be possible or would at least be made considerably difficult.

Thus, when the changeover from the printing units 16, 18 of the set that is active in FIG. 1 to the printing units 12, 14 of the second set shall be performed, it is not sufficient to drive the printing cylinders of the second set and to set them against the CI, but the register thereof, especially the longitudinal register, must be adjusted to that of the printing units 16, 18. This process requires a certain amount of time, so that, in a high-speed printing press operating with a printing speed of 600 to 1000 m/min for example, 100 m or more of the web 22 may be printed with an unacceptable image (waste) before the register is adjusted correctly. For this reason, in the method proposed herein, the adjustment of the register is performed already prior to the changeover of the printing units, so that the production of waste is largely avoided.

Figure 2:
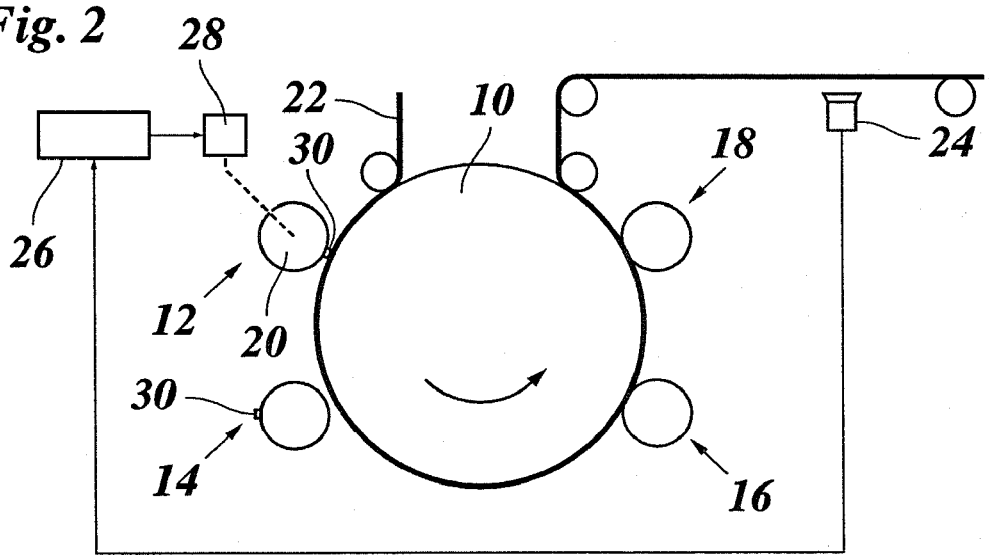
FIG. 2 shows the printing press of FIG. 1 in an operating condition immediately before a changeover of printing units.

According to FIG. 2, the printed image that has been printed onto the web 22 with the printing units 16, 18 of the first set is inspected with a camera 24. The electronic image data are analysed in a control unit 26 in order to determine the actual register of the printed image on the web relative to a suitable reference. In particular, the control unit 26 determines a value for the longitudinal register of the printed image.

Each of the printing cylinders of the individual printing units have a separate drive unit, so that the angular position of each printing cylinder can be controlled individually. As an example, FIG. 2 shows a motor 28 for driving the printing cylinder of the printing unit 12. Now, in order to correctly adjust the register for the printing cylinders of the printing units 12 and 14, the drive units of the printing cylinders must be controlled such that the printed image is formed in the correct position on the web. However, during this operation, the printing cylinders of the printing units 12 and 14 shall not yet print an image onto the web, because, prior to the changeover, the printed image is still printed with the printing units 16 and 18. For this reason, as has been shown schematically in FIG. 2, the printing cylinders 20 of the printing units 12 and 14 each have a register printing block 30 which is elevated relative to the peripheral surface of the printing cylinder or, more exactly, the peripheral surface of the printing blocks that serve for printing the desired image. In FIG. 2, the printing cylinders 20 are set against the CI 10 only to such an extent that only the register printing blocks 30 but not the regular printing blocks may contact the web 22. In FIG. 2, it is the register printing block 30 of the printing unit 12 that just contacts the web.

Thus, in the operating condition shown in FIG. 2, the printing units 12 and 14 of the second set are used only for printing register marks onto the web 22 on which the desired image and possibly further register marks will then be printed by means of the printing units 16 and 18 of the first set. The register marks formed with the printing units 12 and 14 are detected by the camera 24, and by reference to these register marks, the control unit 26 can determine the actual value of the longitudinal register of the printing cylinders 12 and 14 and compare it to a target value which is given by the actual longitudinal register of the image printed with the printing units 16, 18. Then, the control unit 26 controls the motor 28 for the printing cylinder 20 so as to advance or delay the printing cylinder until the actual value for the longitudinal register coincides with the target value. In this way, the longitudinal register of the printing units 12 and 14 is precisely adjusted to the longitudinal register of the printing units 16 and 18. Optionally, the side register of the printing units 12 and 14 may be adjusted or checked and possibly corrected at the same time.

Figure 3:
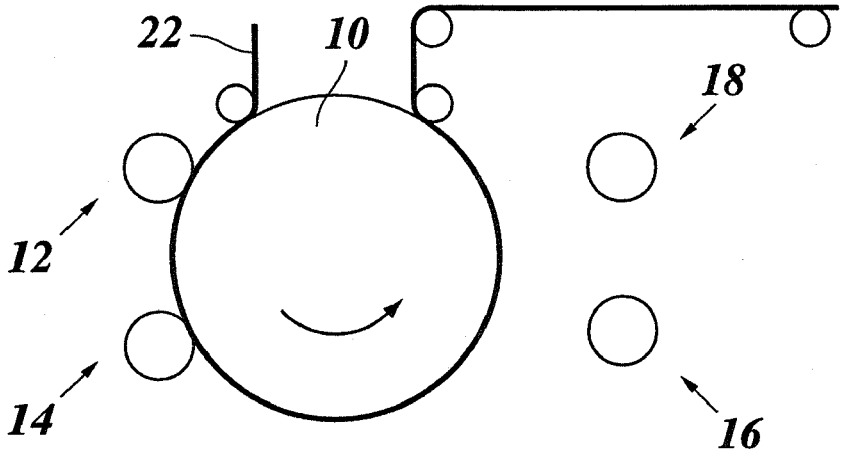
FIG. 3 shows the printing press in an operating condition after the changeover.

It is only when the register has been precisely adjusted in this way that the actual changeover is performed by fully setting the printing cylinders of the printing units 12 and 14 against the CI 10 and simultaneously withdrawing the printing cylinders of the printing units 16 and 18 from the CI, as has been shown in FIG. 3. Now, the printing cylinders 20 of the printing units 12 and 14 roll over the web 22 with their peripheral surface, i.e. with their printing blocks, so that the image is now printed with these printing cylinders. The elevated register printing blocks 30 are under these conditions radially pressed back into the respective printing cylinder so that they do not hamper the printing operation.

In the condition shown in FIG. 3, the printing cylinders of the printing units 16, 18 of the first set may be cleaned, so that, later, when the printing cylinders of the printing units 12 and 14 of the second set have become soiled, it is possible to switch back again to the printing units 16, 18 of the first set. Then, prior to this new changeover, the register of the printing units 16 and 18 is adjusted in a procedure analogous to the one shown in FIG. 2.

Figure 4:
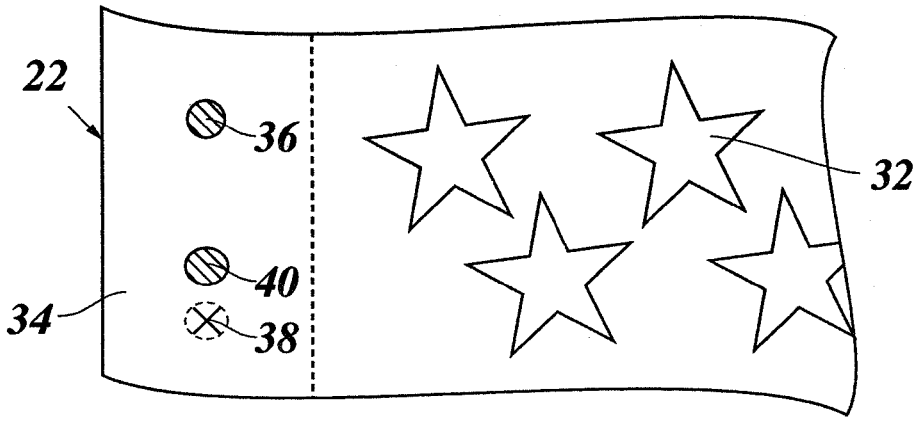
FIG. 4 shows a section of a web of a printing medium including a margin with register marks printed thereon.

FIG. 4 shows a section of the web 22 onto which an image 32 has been printed with the printing units 16, 18 of the first set. In addition, register marks 36 have been printed on a margin 34 of the web by means of these printing units (preferably at least one register mark per printing unit of the first set). The register marks 36 are detected by the camera 24 and are electronically processed in the control unit 26. In this process, the colour dot forming the register mark is measured, and the exact co-ordinates of the "center of gravity"thereof are calculated. Then, these co-ordinates serve as a reference for adjusting the register, in particular the longitudinal register, of the printing units 12, 14 of the second set. Then, on the basis of this reference and the known position of the register printing blocks 30 relative to the respective image, the control unit 26 calculates a target position 38 for the register mark 40 that is printed with the register printing block 30 of the printing unit 12 and 14, respectively, in the condition shown in FIG. 2. Then, the drive unit for the respective printing cylinder is controlled such that the longitudinal position of the register mark 40 on the web is shifted until it coincides with the target position 38. Subsequently, the actual changeover is performed, corresponding to a transition from the condition shown in FIG. 2 to the condition shown in FIG. 3.

Figure 5:
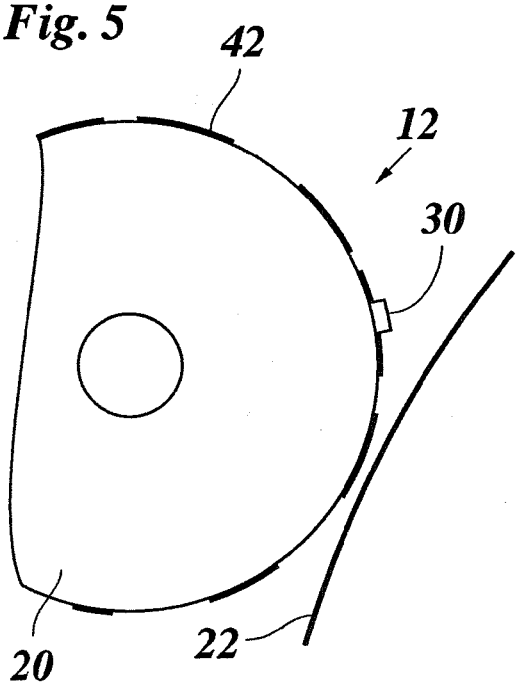
FIGS. 5 and 6 are enlarged schematic views of a printing cylinder in a set position for printing register marks.
Figure 6:
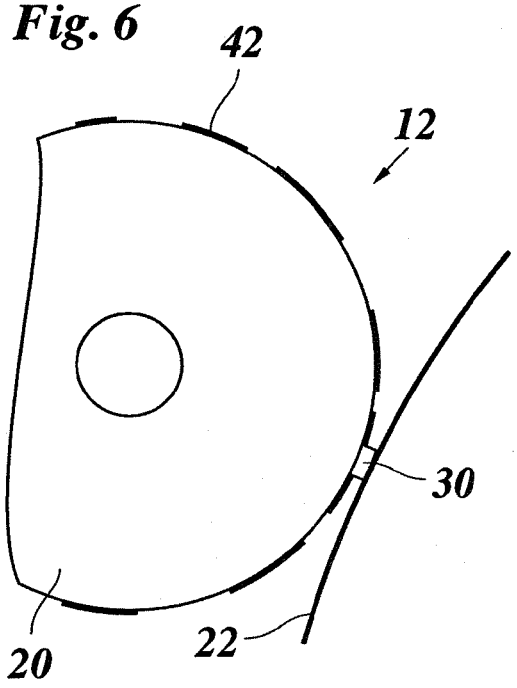
Figure 7:
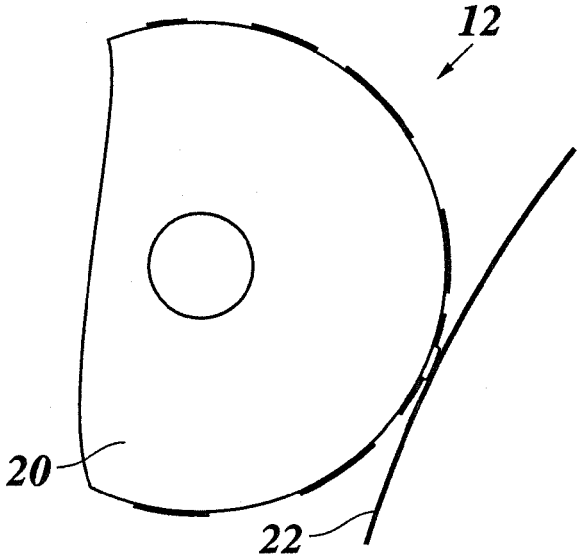
FIG. 7 shows the printing cylinder of FIGS. 5 and 6 in a set position for printing the actual image.

In FIGS. 5, 6 and 7, the printing cylinder of the printing unit 12 has been shown in an enlarged scale. A printing block 42 serving for printing the desired image has been indicated on the peripheral surface of the printing cylinder. FIGS. 5 and 6 show the position of the printing cylinder 20 at the time when the register is adjusted. As can be seen especially in FIG. 5, the printing block 42 does not yet contact the web 22 in this position. Only the register printing block 30 can contact the web 22 and can print one or more register marks as has been shown in FIG. 6.

The register printing block 30 is made of an elastically compressible material. When the printing cylinder 20 is fully set against the CI, so that the printing block 42 rolls over the web 22 and prints an image onto the web, as shown in FIG. 7, the register printing block 30, each time it reaches the position shown in FIG. 7 where it faces the web, can be compressed by the CI to such an extent that it retreats into the surface of the printing block 42. After this, it will always restore its original posture, so that it may again be used for printing the register marks 40 during the next but one changeover of the printing units.

What is claimed is:

1. A method of exchanging printing units at a running rotary printing press, wherein a first printing unit is withdrawn from a printing medium, and a second printing unit for printing an identical image with an identical register is set against the printing medium, comprising the steps of:

applying to a printing cylinder of the second printing unit, prior to a start of a printing operation, a register printing block that is elevated relative to a regular printing block of said printing cylinder, prior to a changeover of the printing units, setting the second printing unit against the printing medium to such an extent that register marks are printed with the register printed block, without an image being printing with the regular printing block thereof, detecting the register marks and adjusting the register of the second printing unit by reference to the detected register mark, when the register has been adjusted, exchanging the printing units by withdrawing the first printing unit and fully setting the second printing unit.

2. The method according to claim 1, wherein the register printing block is made of an elastic material and, further comprising the step of, when printing with the second printing unit, radially pressing back the register printing block so far that it no longer projects beyond an outer surface of the regular printing block, at least in a position where the outer surface contacts the printing medium.

3. The method according to claim 1, further comprising the steps of:

arranging the register printing block to print onto the printing medium a register mark that is shaped as an extended color dot, electronically measuring this color dot, and calculating the position of a center of gravity thereof on the basis of measured results.

4. The method according to claim 1, wherein a printing cylinder of the first printing unit is used for printing register marks that serve as a reference for adjusting the register of the second printing unit.

5. The method according to claim 1, further comprising the steps of:

prior to the start of the printing operation, also applying a register printing block to the printing cylinder of the first printing unit, and during the printing operation, alternatingly exchanging the first printing unit and the second printing unit with one another, and performing an adjustment of the register of the first printing unit prior to each change from the second printing unit to the first printing unit.

6. The method according to claim 1, wherein, during the process of adjusting the register, only the register printing block but not the regular printing block is inked.

* * * * *